US008058863B2

(12) United States Patent
Cho et al.

(10) Patent No.: US 8,058,863 B2
(45) Date of Patent: Nov. 15, 2011

(54) BAND-GAP REFERENCE VOLTAGE GENERATOR

(75) Inventors: Young Kyun Cho, Daejeon (KR); Young Deuk Jeon, Daejeon (KR); Jae Won Nam, Daejeon (KR); JongKee Kwon, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 426 days.

(21) Appl. No.: 12/428,425

(22) Filed: Apr. 22, 2009

(65) Prior Publication Data

US 2010/0052643 A1 Mar. 4, 2010

(30) Foreign Application Priority Data

Sep. 1, 2008 (KR) ..... 10-2008-0085999

(51) Int. Cl.
*G05F 3/16* (2006.01)

(52) U.S. Cl. ..... 323/316; 323/315

(58) Field of Classification Search ..... 323/313–317; 327/538, 539

See application file for complete search history.

(56) References Cited

U.S. PATENT DOCUMENTS 4,827,207 A * 5/1989 Chieli ..... 323/316
5,581,174 A * 12/1996 Fronen ..... 323/316
6,844,772 B2 * 1/2005 Hoon et al. ..... 327/541
7,119,528 B1 10/2006 Rasmus
7,253,597 B2 8/2007 Brokaw
7,253,599 B2 8/2007 Chen et al.
7,259,543 B2 8/2007 Chih
7,268,529 B2 * 9/2007 Mochizuki et al. ..... 323/316

FOREIGN PATENT DOCUMENTS

JP 11-045126 A 2/1999
KR 1020000009916 A 2/2000
KR 102005104027 A 11/2005
KR 100738964 B1 7/2007
KR 1020070115143 A 12/2007

OTHER PUBLICATIONS

Ming-Dou Ker et al., "New Curvature-Compensation Technique for CMOS Bandgap Reference With Sub-I-V Operation," IEEE Transactions on Circuits and Systems—II, Aug. 2006, pp. 667-671, vol. 53, No. 8.

Ka Nang Leung et al., "A Sub-I-V 15-ppm/° C. CMOS Bandgap Voltage Reference Without Requiring Low Threshold Voltage Device," IEEE Journal of Solid-State Circuits, Apr. 2002, pp. 526-530, vol. 37, No. 4.

Ka Nang Leung et al., "A 2-V 23μA 5.3-ppm/° C. Curvature-Compensated CMOS Bandgap Voltage Reference," IEEE Journal of Solid-State Circuits, Mar. 2003, pp. 561-564, vol. 38, No. 3.

* cited by examiner

*Primary Examiner* — Matthew Nguyen

(57) ABSTRACT

A band-gap reference voltage generator is provided. N-channel metal oxide semiconductor (NMOS) transistors are respectively connected to bipolar transistors in parallel. A Complementary To Absolute Temperature (CTAT) voltage that is inversely proportional to absolute temperature is reduced by a threshold voltage of the NMOS transistor. A weight for a temperature coefficient of a Proportional To Absolute Temperature (PTAT) voltage that is directly proportional to absolute temperature is reduced and a resistance ratio for a temperature coefficient of 0 is reduced by about ½, thereby miniaturizing the band-gap reference voltage generator. A reference voltage lower than or equal to 1 V can be provided by resistors respectively connected to the bipolar transistors in parallel.

8 Claims, 5 Drawing Sheets

——— Conventional temperature compensation curve($\alpha$=20)

- - - - - Temperature compensation curve according to an exemplary embodiment of present invention($\alpha$=10)

| Version | ⊿VBGR(mV, @-25~125°C) | | | ppm | | |
|---|---|---|---|---|---|---|
| | SS | TT | FF | SS | TT | FF |
| Present invention | 15.06 | 0.973 | 5.243 | 20826.8 | 1345.6 | 7250.7 |
| | TC(ppm/°C) | | | PSRR(dB, @1K) | | |
| | SS | TT | FF | SS | TT | FF |
| | 138.8 | 9.0 | 48.3 | 32.69 | 78.62 | 35.52 |

| Version | ⊿VBGR(mV, @−25~125°C) | | | ppm | | |
|---|---|---|---|---|---|---|
| | SS | TT | FF | SS | TT | FF |
| Conventional | 11.75 | 3.658 | 5.54 | 15953.8 | 4966.7 | 7522.1 |
| | TC(ppm/°C) | | | PSRR(dB, @1K) | | |
| | SS | TT | FF | SS | TT | FF |
| | 106.4 | 33.1 | 50.1 | 27.8 | 77.86 | 30.5 |

BAND-GAP REFERENCE VOLTAGE GENERATOR

CROSS-REFERENCE TO RELATED APPLICATION

This application claims priority to and the benefit of Korean Patent Application No. 10-2008-0085999, filed Sep. 1, 2008, the disclosure of which is incorporated herein by reference in its entirety.

BACKGROUND

1. Field of the Invention

The present invention relates to a band-gap reference voltage generator, and more particularly, to a band-gap reference voltage generator that can be miniaturized by reducing a size of a resistor occupying a large chip area and can provide a stable reference voltage lower than or equal to 1 V.

2. Discussion of Related Art

In general, all analog/radio frequency (RF) circuits or digital circuits manufactured with chips need a stable and accurate bias voltage for efficient operation. Therefore, a band-gap reference voltage generator is used to provide a stable reference voltage regardless of temperature variation.

However, a conventional band-gap reference voltage generator provides a reference voltage of about 1.25 V, it is not applicable to a circuit designed for applying a voltage lower than or equal to 1 V. There is a problem in that a power supply voltage of at least 1.5 V should be used to ensure smooth operation of transistors used in the reference voltage generator.

On the other hand, a small-area and low-power core chip design for guaranteeing portability and long lifespan is important in widely-used mobile communication terminals.

With the development of deep sub-micron CMOS technology, a small area and low power (or low voltage) may be implemented. However, there is a problem in circuit design since only a core band-gap bias circuit within a chip needs an operation voltage of at least 1.5 V when a low supply voltage is used for a low-power design.

To address this problem, a band-gap reference voltage generator for reducing a reference voltage to 1 V or less using a resistor has been proposed. However, this band-gap reference voltage generator has a problem of increased circuit area since a relatively large-sized resistor is needed.

SUMMARY OF THE INVENTION

The present application is directed to a compact band-gap reference voltage generator that can be miniaturized and can provide a stable reference voltage lower than or equal to 1 V.

According to an exemplary embodiment of the present invention, there is provided a band-gap reference voltage generator including: first to third p-channel metal oxide semiconductor (PMOS) transistors of a current mirror having gates and sources connected in common to a first node and a power supply voltage, and drains respectively connected to second, third, and fourth nodes; a feedback amplifier having inverted and non-inverted input terminals respectively connected to the second and third nodes and an output terminal connected to the first node; first and second resistors respectively connected between the second node and a fifth node and between the second node and a sixth node; third and fourth resistors respectively connected between the third node and a seventh node and between the fourth node and a ground; first and second bipolar transistors having emitters respectively connected to the fifth node and the third node and collectors and bases connected to the ground; and fourth and fifth n-channel metal oxide semiconductor (NMOS) transistors respectively having gates and drains connected in common to the sixth node and the seventh node and sources connected to the ground, wherein a voltage between the fourth node and the ground is used as a reference voltage.

The reference voltage may be computed by:

$$V_{ref} = R_4 \cdot I_3 = R_4 \cdot I_2 = R_4 \cdot \left(\frac{V_T \cdot \ln n}{R_1} + \frac{V_{BE2} - V_{TH_M5}}{R_3}\right),$$

where $R_1$, $R_3$, and $R_4$ denote the first, third, and fourth resistors, $I_2$ and $I_3$ denote currents flowing through the second and third PMOS transistors, $V_T$ denotes a thermal voltage, n denotes the number of bipolar transistors, $V_{BE2}$ denotes a base-emitter voltage of the second bipolar transistor, and $V_{TH_M5}$ denotes a threshold voltage of the fifth NMOS transistor.

That is, a Proportional To Absolute Temperature (PTAT) voltage that is directly proportional to absolute temperature in the band-gap reference voltage generator becomes the thermal voltage $V_T$, a Complementary To Absolute Temperature (CTAT) voltage that is inversely proportional to absolute temperature becomes a difference ($V_{BE2}-V_{TH_M5}$) between the base-emitter voltage $V_{BE2}$ of the second bipolar transistor and the threshold voltage $V_{TH_M5}$ of the fifth NMOS transistor, and the weight for the thermal voltage $V_T$ is computed by $\alpha=\ln n*(R_3/R_1)$.

The CTAT voltage that is inversely proportional to absolute temperature is reduced by the threshold voltage $V_{TH_M5}$ of the fifth NMOS transistor. The band-gap reference voltage generator according to an exemplary embodiment of the present invention can reduce the weight $\alpha$ for the thermal voltage $V_T$ in order to set a sum of temperature coefficients to 0.

A stable reference voltage lower than or equal to 1 V may be provided by the second and third resistors respectively connected to the first and second bipolar transistors in parallel regardless of temperature variation.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Hereinafter, exemplary embodiments of the present invention will be described with reference to the accompanying drawings. Although exemplary embodiments of the present invention have been disclosed for illustrative purposes, those skilled in the art will appreciate that various modifications, additions, and substitutions are possible, without departing from the scope of the present invention. Therefore, the present invention is not limited to the exemplary embodiments.

To inspect the main differences between the band-gap reference voltage generator according to an exemplary embodiment of the present invention and the conventional band-gap reference voltage generator, structure and operation of the conventional band-gap reference voltage generator will be described in detail.

Figure 1:
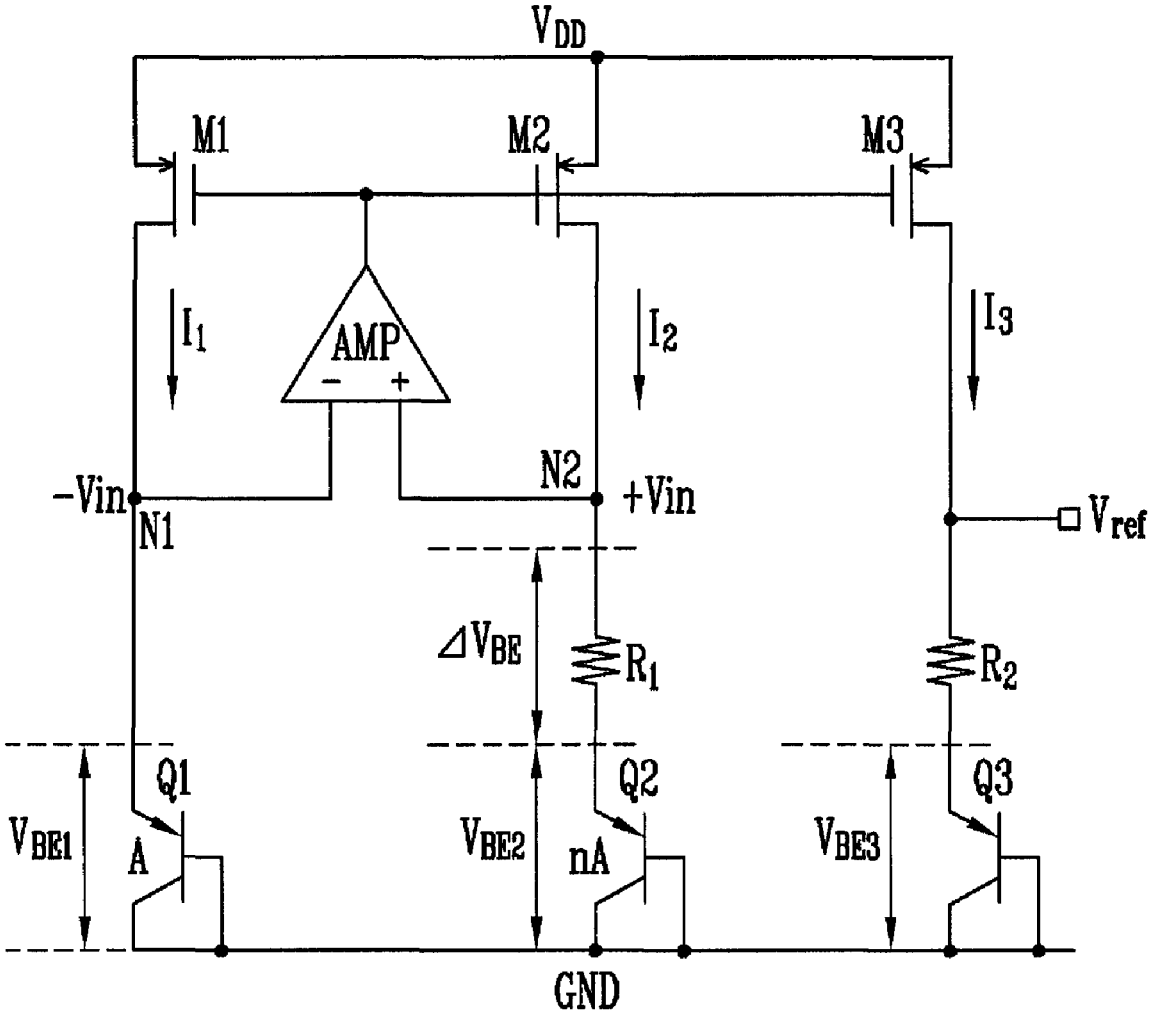
FIG. 1 (PRIOR ART)
FIG. 1 is a circuit diagram illustrating a conventional CMOS band-gap reference voltage generator.

FIG. 1 is a circuit diagram illustrating a conventional complementary metal oxide semiconductor (CMOS) band-gap reference voltage generator.

Referring to FIG. 1, the conventional CMOS band-gap reference voltage generator includes first to third p-channel metal oxide semiconductor (PMOS) transistors M1~M3, a feedback amplifier AMP, first and second resistors $R_1$ and $R_2$, and first to third bipolar transistors Q1~Q3.

A reference voltage $V_{ref}$ output from the band-gap reference voltage generator configured as described above is independent of temperature and may be numerically described as follows.

A voltage across the first resistor $R_1$ is computed by $\Delta V_{BE}=V_{BE1}-V_{BE2}$. When $\Delta V_{BE}$ is converted into temperature-related expression, Equation 1 is obtained:

$$\begin{aligned}\Delta V_{BE} &= V_{BE1} - \Delta V_{BE2} \\ &= V_T \cdot \ln\frac{I_{C1}}{I_{S1}} - V_T \cdot \ln\frac{n \cdot I_{C2}}{I_{S2}} \\ &= V_T \cdot \ln n\end{aligned} \quad \text{(Equation 1)}$$

In Equation 1, $I_{S1}$ and $I_{S2}$ denote reverse saturation currents of the first and second bipolar transistors Q1 and Q2, $I_{C1}$ and $I_{C2}$ denote currents flowing through the first and second bipolar transistors Q1 and Q2, n denotes the number of bipolar transistors, and $V_T$ denotes a Proportional To Absolute Temperature (PTAT) voltage as a thermal voltage in the band-gap reference voltage generator.

Since ln n is a constant in Equation 1, the voltage $\Delta V_{BE}$ across the first resistor $R_1$ increases in direct proportion to $V_T$, which is directly proportional to temperature.

Next, a current $I_2$ flowing through the first resistor $R_1$ is mirrored to the third PMOS transistor M3 by directly reproducing temperature characteristics of $\Delta V_{BE}$. A mirrored current $I_3$ flows through the second resistor $R_2$ and the third bipolar transistor Q3.

A base-emitter voltage $V_{BE3}$ of the third bipolar transistor Q3 decreases in inverse proportion to the temperature.

$\Delta V_{BE}$ is a temperature variable increasing in direct proportion to the temperature and $V_{BE3}$ is a temperature variable decreasing in inverse proportion to the temperature. When the two temperature variables are set to zero by properly adjusting a resistance ratio of the first and second resistors $R_1$ and $R_2$, a reference voltage $V_{ref}$ that is independent of temperature can be obtained, as shown in Equation 2:

$$\begin{aligned}V_{ref} &= V_{BE3} + \frac{R_2}{R_1}\Delta V_{BE} \\ &= V_{BE3} + \frac{R_2}{R_1}(V_T \ln n) \\ &\approx 1.25\text{ V}\end{aligned} \quad \text{(Equation 2)}$$

As shown in Equation 2, the conventional band-gap reference voltage generator has a perfect temperature characteristic (that is, a temperature coefficient of 0) around a theoretical reference voltage $V_{ref}$ of about 1.25 V, it is not applicable to a circuit designed for applying a voltage lower than or equal to 1 V. There is a problem in that a power supply voltage of at least 1.5 V should be used to ensure smooth operation of transistors used in the reference voltage generator.

In contrast, the band-gap reference voltage generator according to an exemplary embodiment of the present invention can provide a stable reference voltage lower than or equal to 1 V and can be miniaturized. Structure and operation of the band-gap reference voltage generator according to an exemplary embodiment of the present invention will be described in detail.

Figure 2:
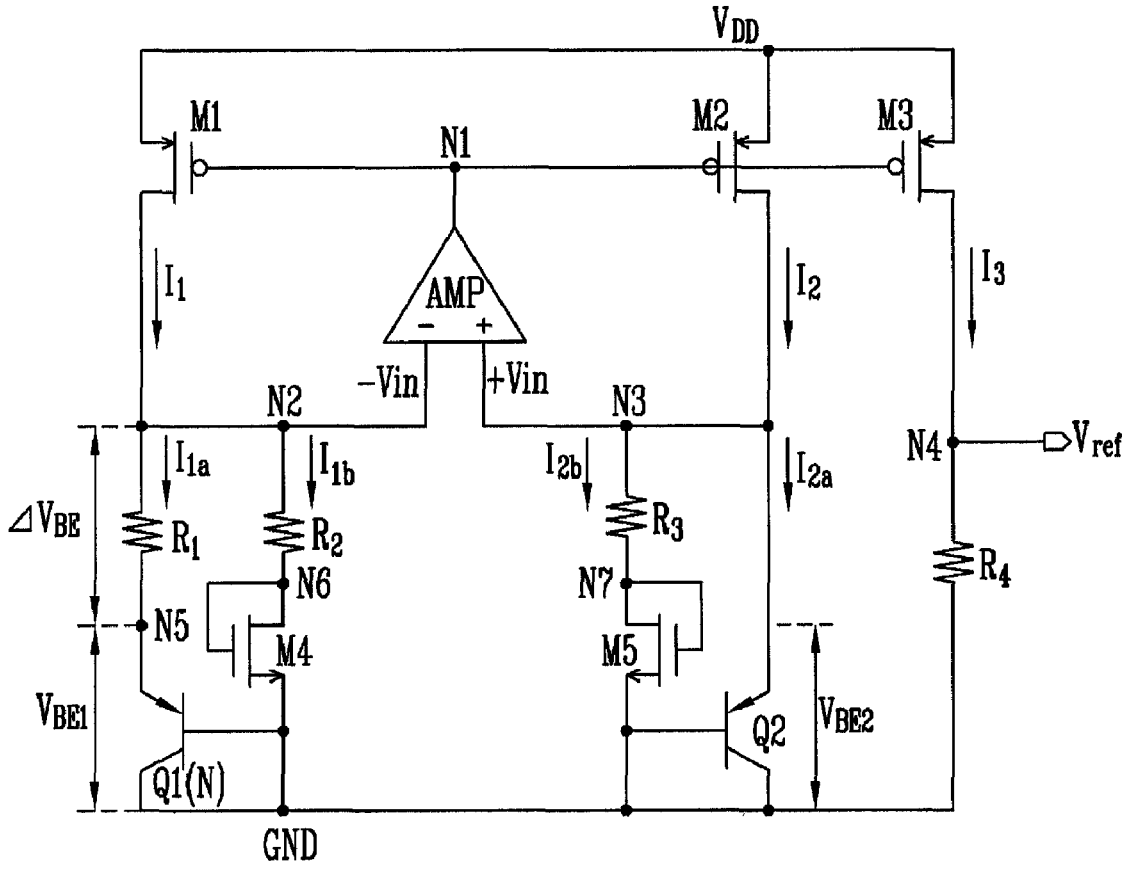
FIG. 2 is a circuit diagram illustrating a band-gap reference voltage generator according to an exemplary embodiment of the present invention.

FIG. 2 is a circuit diagram illustrating a band-gap reference voltage generator according to an exemplary embodiment of the present invention.

Referring to FIG. 2, the band-gap reference voltage generator includes first to third PMOS transistors M1~M3, a feedback amplifier AMP, first to fourth resistors $R_1$~$R_4$, first and second bipolar transistors Q1~Q2, and fourth and fifth NMOS transistors M4 and M5.

A connection relation between the components will be described briefly.

The first to third PMOS transistors M1~M3 are configured in the form of a current mirror. The first to third PMOS transistors M1~M3 have gates connected in common to a first node N1, sources connected in common to a power supply voltage $V_{DD}$, and drains respectively connected to second, third, and fourth nodes N2, N3, and N4. To improve Power Supply Rejection Ratio (PSRR) characteristics, it is possible to configure the current mirror by stacking multi-stage PMOS transistors.

The feedback amplifier AMP has inverted and non-inverted input terminals $-V_{in}$ and $+V_{in}$ respectively connected to the second and third nodes N2 and N3, and an output terminal connected to the first node N1.

The first resistor $R_1$ is connected between the second node N2 and a fifth node N5, the second resistor $R_2$ is connected between the second node N2 and a sixth node N6, and the third resistor $R_3$ is connected between the third node N3 and a seventh node N7. The fourth resistor $R_4$ is connected between the fourth node N4 and a ground GND and a reference voltage $V_{ref}$ is connected to the fourth node N4.

The first bipolar transistor Q1 has an emitter connected to the fifth node N5 and a collector and base connected to the ground GND. The second bipolar transistor Q2 has an emitter connected to the third node N3 and a collector and base connected to the ground GND.

The fourth NMOS transistor M4 has a gate and drain connected in common to the sixth node N6 and a source connected to the ground GND. The fifth NMOS transistor M5 has a gate and drain connected in common to the seventh node N7 and a source connected to the ground GND.

When an output voltage of the feedback amplifier AMP is applied to gates of the first to third PMOS transistors M1~M3 in a state in which the first to third PMOS transistors M1~M3 are in a saturation mode, the same current flows through the first to third PMOS transistors M1~M3 by current mirroring. That is, $I_1=I_2=I_3$. Here, the current $I_1$ is divided into $I_{1a}$ and $I_{1b}$, and the current $I_2$ is divided into $I_{2a}$ and $I_{2b}$. That is, $I_1=I_{1a}+I_{1b}$, and $I_2=I_{2a}+I_{2b}$.

The voltages of the second node N2 and the third node N3 have the same magnitude by current mirroring of $I_1$ and $I_2$. When the second resistor $R_2$ is the same as the third resistor $R_3$, that is, when $R_2=R_3$, $I_{1a}=I_{2a}$ and $I_{1b}=I_{2b}$.

The current $I_{2a}$ flowing through the second bipolar transistor Q2 can be defined as shown in Equation 3:

$$I_{2a}=I_{S2}\cdot e^{V_{BE2}/V_T} \quad \text{(Equation 3)}$$

In Equation 3, $I_{S2}$ and $V_{BE2}$ each denote a reverse saturation current and a base-emitter voltage of the second bipolar transistor Q2, and $V_T$ denotes a thermal voltage.

When Equation 3 is converted into a numerical expression related to the base-emitter voltage $V_{BE2}$ of the second bipolar transistor Q2, Equation 4 is obtained:

$$V_{BE2} = V_T \cdot \ln\frac{I_{2a}}{I_{S2}} \quad \text{(Equation 4)}$$

The base-emitter voltage $V_{BE2}$ of the second bipolar transistor Q2 computed by Equation 4 decreases in inverse proportion to the temperature.

The voltage $\Delta V_{BE}$ across the first resistor $R_1$ can be expressed by Equation 5:

$$\begin{aligned}\Delta V_{BE} &= V_{BE2} - V_{BE1} \quad \text{(Equation 5)}\\ &= V_T \cdot \ln\frac{I_{2a}}{I_{S2}} - V_T \cdot \ln\frac{I_{1a}}{I_{S1}}\\ &= V_T \cdot \ln n\end{aligned}$$

In Equation 5, n denotes the number of bipolar transistors and $V_{BE1}$ denotes a base-emitter voltage of n bipolar transistors connected in parallel.

The voltage $\Delta V_{BE}$ across the first resistor $R_1$ computed by Equation 5 increases in direct proportion to the temperature.

Accordingly, the currents $I_{2a}$ and $I_{2b}$ can be expressed as shown in Equation 6:

$$I_{2a} = I_{1a} = \frac{\Delta V_{BE}}{R_1} = \frac{V_T \cdot \ln n}{R_1} \quad \text{(Equation 6)}$$

$$I_{2b} = \frac{V_{BE2} - V_{TH_M5}}{R_3}$$

Since $I_{2a}+I_{2b}=I_2=I_3$ in Equation 6, a target reference voltage $V_{ref}$ can be expressed as shown in Equation 7:

$$\begin{aligned}V_{ref} &= R_4 \cdot I_3 \quad \text{(Equation 7)}\\ &= R_4 \cdot I_2\\ &= R_4 \cdot \left(\frac{V_T \cdot \ln n}{R_1} + \frac{V_{BE2} - V_{TH_M5}}{R_3}\right)\end{aligned}$$

Referring to Equation 7, a PTAT voltage that is directly proportional to absolute temperature in the band-gap reference voltage generator becomes $V_T$, and a CTAT voltage that is inversely proportional to absolute temperature becomes a difference ($V_{BE2}-V_{TH_M5}$) between the base-emitter voltage $V_{BE2}$ of the second bipolar transistor Q2 and the threshold voltage $V_{TH_M5}$ of the fifth NMOS transistor M5.

When weights for temperature coefficients of the PTAT voltage $V_T$ and the CTAT voltage ($V_{BE2}-V_{TH_M5}$) are denoted by α and β, the reference voltage $V_{ref}$ can be obtained regardless of temperature variation when the temperature coefficients are set to zero such that $\alpha*\{\partial V_T/\partial T\}+\beta\{\partial(V_{BE2}-V_{TH_M5})/\partial T\}=0$, by properly selecting α and β.

Since the CTAT voltage by the fourth and fifth NMOS transistors M4 and M5 is reduced by the threshold voltage $V_{TH_M5}$ of the fifth NMOS transistor M5, the weight α(=ln n*($R_3/R_1$)) for the temperature coefficient of the PTAT voltage is reduced in the band-gap reference voltage generator according to an exemplary embodiment of the present invention compared to the conventional band-gap reference voltage generator.

Table 1 shows a comparison of the conventional band-gap reference voltage generator and the band-gap reference voltage generator according to an exemplary embodiment of the present invention.

TABLE 1

| | Temperature coefficient of PTAT voltage | Temperature coefficient of CTAT voltage | Weight α |
|---|---|---|---|
| Conventional | $\partial V_T/\partial T$ = 0.083 mV/° C. | $\partial V_{BE}/\partial T$ = −1.65 mV/° C. | ln n * $R_3/R_1$ = 21.82 |
| Present Invention | $\partial V_T/\partial T$ = 0.083 mV/° C. | $\partial(V_{BE2} - V_{TH_M5})/\partial T$ = −0.45 mV/° C. | ln n * $R_3/R_1$ = 11.09 |

Referring to Table 1, the temperature coefficient ($\partial V_{BE}/\partial T$) of the CTAT voltage in the conventional band-gap reference voltage generator is four times greater than in the band-gap reference voltage generator according to an exemplary embodiment of the present invention. Accordingly, it can be seen that the weight α for the temperature coefficient of the PTAT voltage for setting a sum of temperature coefficients to 0 is also doubled.

That is, the resistance ratio $R_3/R_1$ of the third resistor $R_3$ and the first resistor $R_1$ should increase at least 20 times in order to set all temperature coefficients to 0 in the conventional band-gap reference voltage generator. Since a sum of temperature coefficients can be set to 0 even when the resistance ratio $R_3/R_1$ increases only about 10 times, the size of a resistor occupying a large chip area can be reduced by about ½, thereby miniaturizing the band-gap reference voltage generator.

Since the temperature coefficient of the CTAT voltage is reduced by the fourth and fifth NMOS transistors M4 and M5 and the second and third resistors $R_2$ and $R_3$ respectively connected to the first and second bipolar transistors Q1 and Q2 in parallel in the band-gap reference voltage generator according to an exemplary embodiment of the present invention, a stable reference voltage $V_{ref}$ that is lower than or equal to 1 V can be provided regardless of temperature variation.

Figure 3:
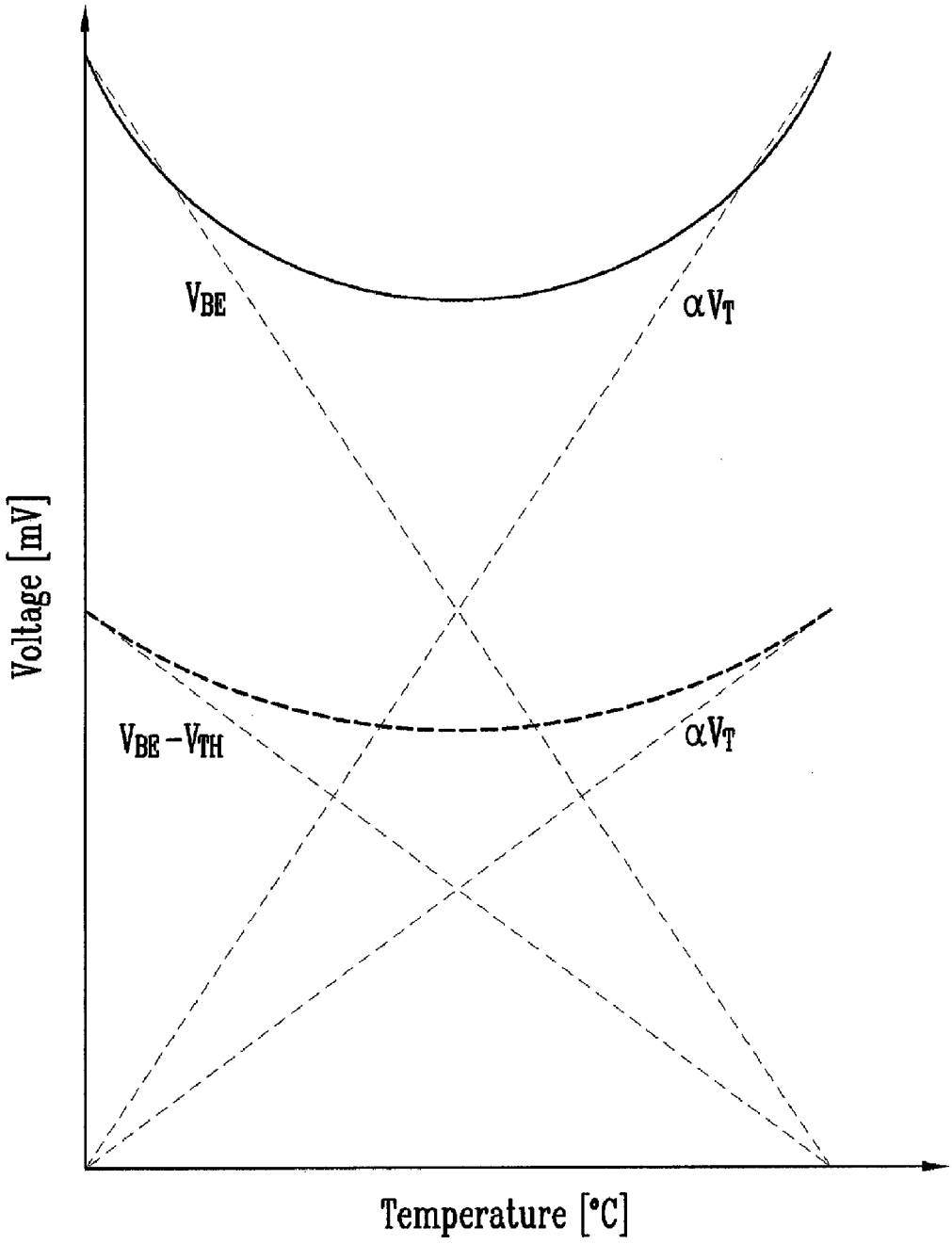
FIG. 3 shows temperature compensation curves of the band-gap reference voltage generator according to an exemplary embodiment of the present invention and the conventional band-gap reference voltage generator.

FIG. 3 shows temperature compensation curves of the band-gap reference voltage generator according to an exemplary embodiment of the present invention and the conventional band-gap reference voltage generator.

As seen in FIG. 3, a temperature coefficient of a CTAT voltage is reduced and a curvature of a temperature compensation curve is reduced in the band-gap reference voltage generator according to an exemplary embodiment of the present invention compared to the conventional band-gap reference voltage generator.

Figure 4:
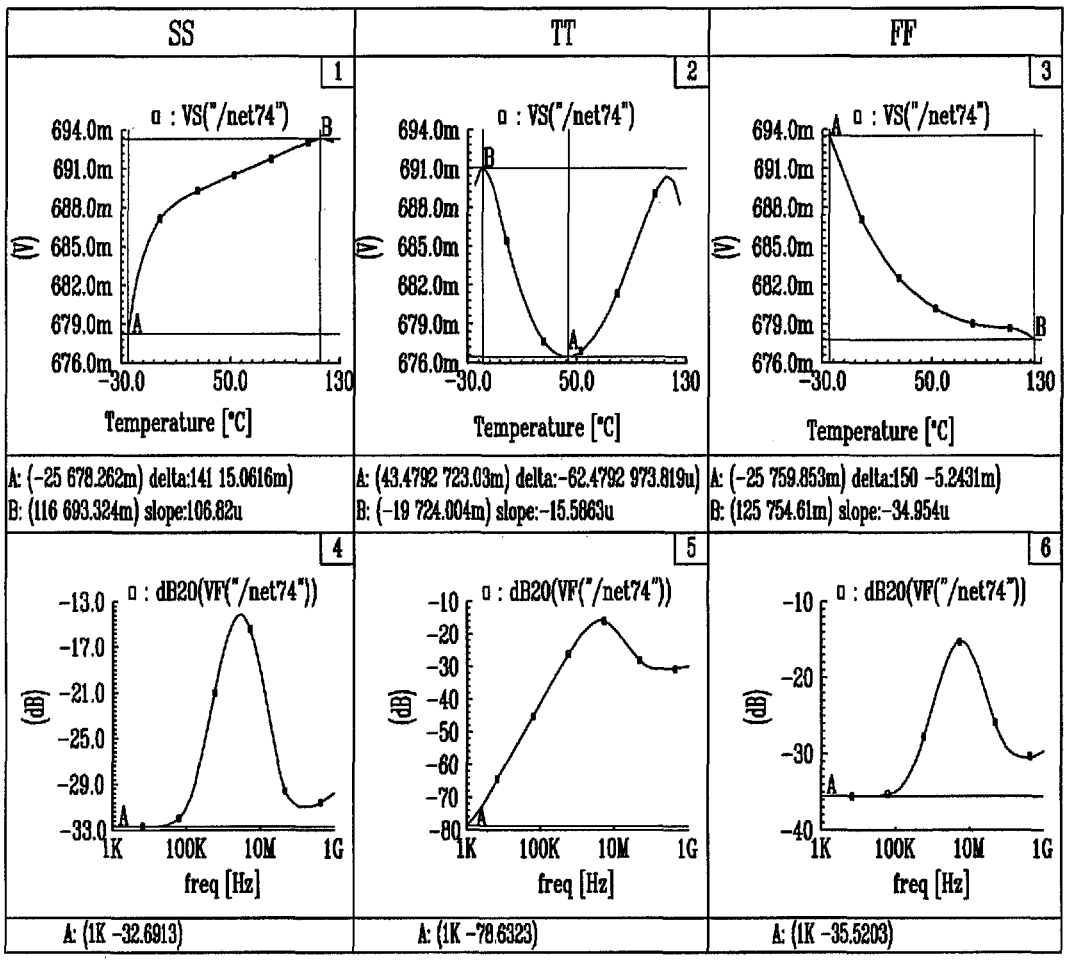
FIGS. 4 and 5 are graphs showing temperature coefficient characteristics of the band-gap reference voltage generator according to an exemplary embodiment of the present invention and the conventional band-gap reference voltage generator, and computer simulation results using three simulation models SS, TT, and FF.
Figure 5:
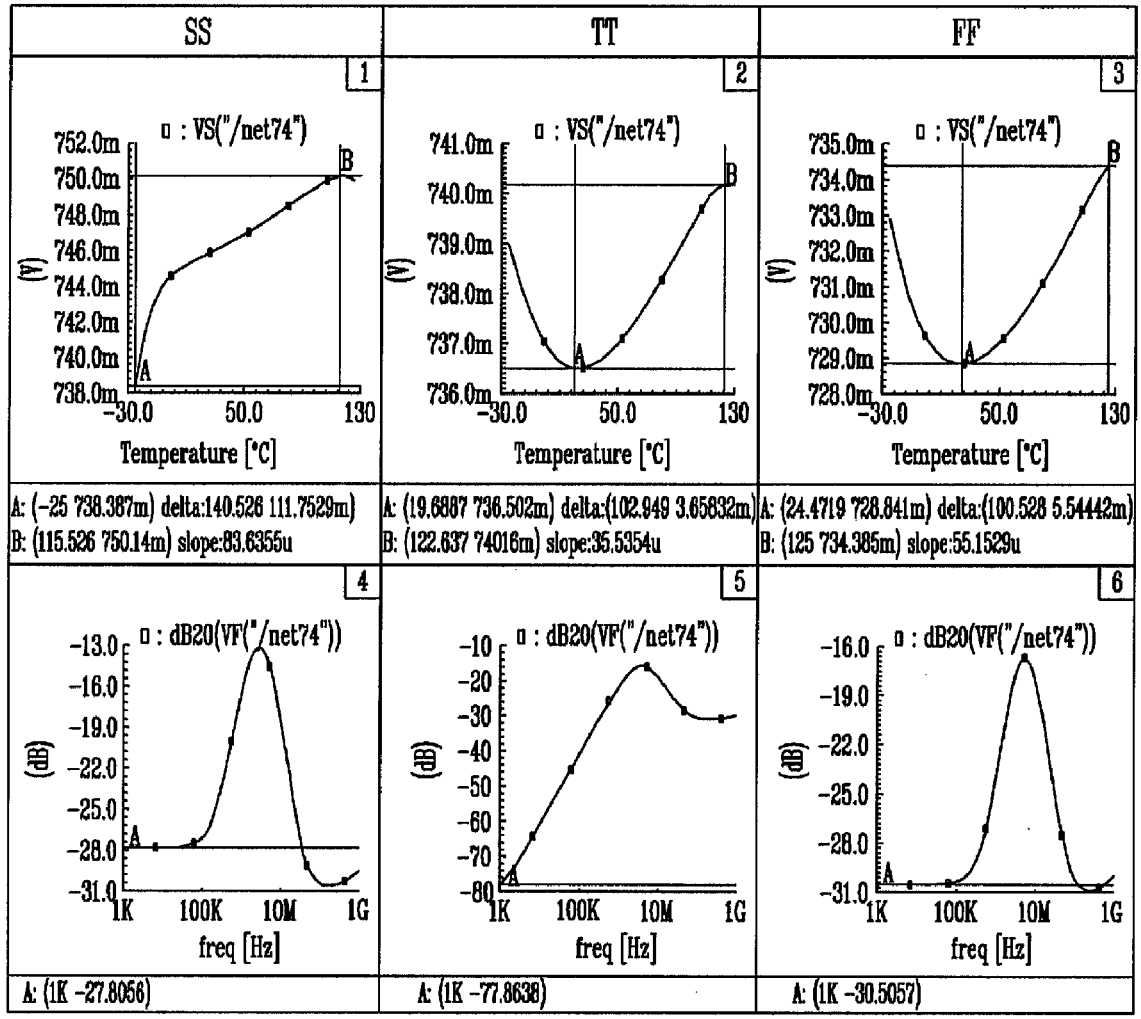

FIGS. 4 and 5 are graphs showing temperature coefficient characteristics of the band-gap reference voltage generator according to an exemplary embodiment of the present invention and the conventional band-gap reference voltage generator, and computer simulation results using three simulation models SS, TT, and FF.

Referring to the computer simulation results of TT shown in FIGS. 4 and 5, the conventional band-gap reference voltage generator has a high temperature coefficient of 33.1 ppm/° C. However, the band-gap reference voltage generator according to an exemplary embodiment of the present invention has a very low temperature coefficient of 9 ppm/° C. and a PSRR of 78 dB.

According to the present invention, a band-gap reference voltage generator can be miniaturized by reducing the size of a resistor occupying a large chip area, since a resistance ratio for a temperature coefficient of 0 is reduced by about ½.

According to the present invention, a stable reference voltage lower than or equal to 1 V can be provided regardless of temperature variation.

While the present invention has been shown and described in connection with exemplary embodiments thereof, it will be apparent to those skilled in the art that various modifications can be made without departing from the spirit and scope of the invention as defined by the appended claims.

What is claimed is:

1. A band-gap reference voltage generator comprising:

first to third p-channel metal oxide semiconductor (PMOS) transistors of a current mirror having gates and sources connected in common to a first node and a power supply voltage, and drains respectively connected to second, third, and fourth nodes;

a feedback amplifier having inverted and non-inverted input terminals respectively connected to the second and third nodes and an output terminal connected to the first node;

first and second resistors respectively connected between the second node and a fifth node and between the second node and a sixth node;

third and fourth resistors respectively connected between the third node and a seventh node and between the fourth node and a ground;

first and second bipolar transistors having emitters respectively connected to the fifth node and the third node and collectors and bases connected to the ground; and fourth and fifth n-channel metal oxide semiconductor (NMOS) transistors respectively having gates and drains connected in common to the sixth node and the seventh node and sources connected to the ground, wherein a voltage between the fourth node and the ground is used as a reference voltage.

2. The band-gap reference voltage generator of claim 1, wherein the second and third resistors have the same resistance.

3. The band-gap reference voltage generator of claim 2, wherein currents flowing through the first resistor and the second bipolar transistor have the same magnitude and currents flowing through the second resistor and the third resistor have the same magnitude.

4. The band-gap reference voltage generator of claim 3, wherein a voltage across the first resistor increases in direct proportion to temperature and a base-emitter voltage of the second bipolar transistor decreases in inverse proportion to temperature.

5. The band-gap reference voltage generator of claim 1, wherein the reference voltage is computed by:

$$V_{ref} = R_4 \cdot I_3 = R_4 \cdot I_2 = R_4 \cdot \left(\frac{V_T \cdot \ln n}{R_1} + \frac{V_{BE2} - V_{TH_M5}}{R_3}\right),$$

where $R_1$, $R_3$, and $R_4$ denote the first, third, and fourth resistors, $I_2$ and $I_3$ denote currents flowing through the second and third PMOS transistors, $V_T$ denotes a thermal voltage, n denotes the number of bipolar transistors, $V_{BE2}$ denotes a base-emitter voltage of the second bipolar transistor, and $V_{TH_M5}$ denotes a threshold voltage of the fifth NMOS transistor.

6. The band-gap reference voltage generator of claim 5, wherein a weight for the thermal voltage ($V_T$) is computed by $\alpha = \ln n * (R_3/R_1)$ and is reduced such that the reference voltage becomes independent of temperature.

7. The band-gap reference voltage generator of claim 5, wherein the reference voltage is between 0 and 1 V.

8. The band-gap reference voltage generator of claim 5, wherein a resistance of the fourth resistor is adjusted such that the reference voltage is independent of temperature.

* * * * *